United States Patent [19]

Bull

[11] Patent Number: 4,862,519

[45] Date of Patent: Sep. 5, 1989

[54] HANDWARMER PACK

[76] Inventor: John A. Bull, 4220 N. Morris Blvd., Shorewood, Wis. 53211

[21] Appl. No.: 141,205

[22] Filed: Jan. 6, 1988

[51] Int. Cl.[4] ..... A45C 03/14

[52] U.S. Cl. ..... 2/66; 150/112

[58] Field of Search ..... 2/16, 66, 69.5, 70, 2/208; 150/107, 112

[56] References Cited

U.S. PATENT DOCUMENTS

| | | | |
|---|---|---|---|
| 255,420 | 3/1882 | Cuningham . | |
| 369,817 | 9/1887 | Salamon . | |
| 1,810,894 | 6/1931 | Cotler et al. | 2/66 |
| 1,817,750 | 8/1931 | Lipscutz et al. | 2/66 |
| 1,987,759 | 1/1935 | Srulowitz | 2/66 |
| 2,014,256 | 9/1935 | Kramer | 2/66 |
| 2,086,326 | 7/1937 | Goldberg | 2/66 |
| 2,557,280 | 6/1951 | Hahn | 2/66 |
| 2,727,241 | 12/1955 | Smith | 2/66 |
| 2,835,896 | 5/1958 | Giese | 2/66 |
| 3,793,643 | 2/1974 | Kinoshita | 2/66 |
| 3,845,503 | 6/1888 | Brahadi | 2/66 |
| 4,408,355 | 10/1988 | Brock | 2/66 |

*Primary Examiner*—Werner H. Schroeder
*Assistant Examiner*—Jeanette E. Chapman

[57] ABSTRACT

A fanny pack in combination with an insulated handwarmer muff provides a device for carrying objects and a handwarming device, each of which can be used independently of the other. The handwarmer pack is worn to the rear of the user's body on the hips. When turned to the front of the user's body the user's hands may be inserted into an insulated handwarmer muff through separate openings which do not give access to the compartment in which objects are carried. With the muff removed, the other contents of the pack are unaffected, while the muff can still be used to warm the hands, or opened flat as a seat cushion. The pocket which housed the muff is then available for additional carrying space, while the contents of the main compartment, or fanny pack are accessible by means of a separate opening at the top.

8 Claims, 4 Drawing Sheets

FIG. 5
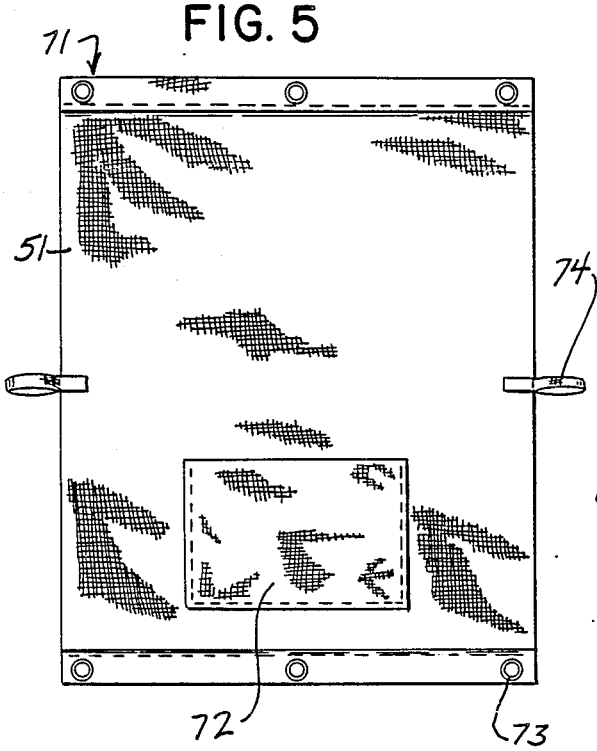
FIG. 6
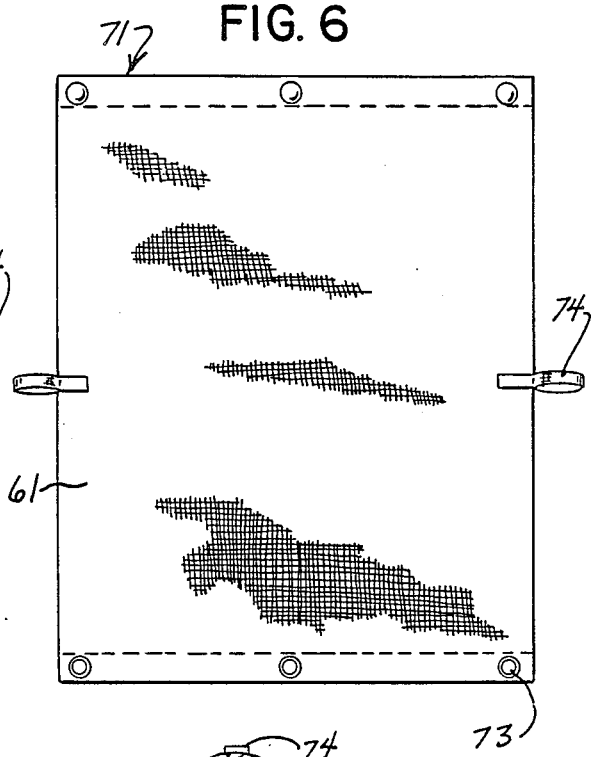
FIG. 7
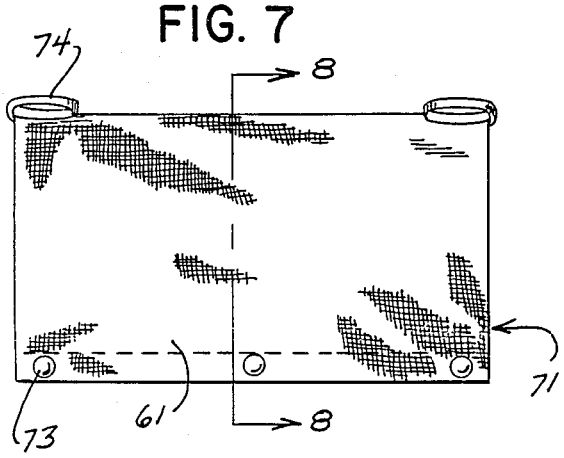
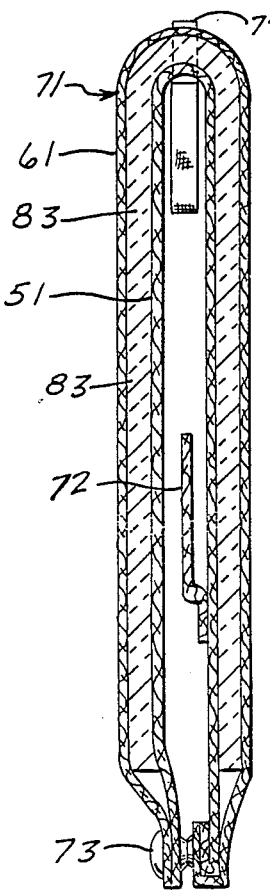
FIG. 8

HANDWARMER PACK

U.S. PRIOR ART OF INTEREST

| U.S. Pat. No. | Inventor | Issued |
|---|---|---|
| 255,420 | Cuningham | 3/1882 |
| 369,817 | Salamun | 9/1887 |
| 2,727,241 | Smith | 12/1855 |
| 2,835,896 | Giese | 5/1958 |
| 3,793,634 | Kinoshita | 2/1974 |
| 4,408,355 | Brock | 10/1983 |

BACKGROUND AND SUMMARY OF THE INVENTION

This invention, a combination handwarmer muff and fanny pack enables the user to carry the equipment and supplies needed for cold weather outdoor activities, such as hunting, skiing, ice fishing, spectator sports, etc., and provides an insulated handwarmer muff for the warmth and protection of the hands in those instances where gloves or mittens would not allow sufficient dexterity, and where frequently having to remove them would be inconvenient or uncomfortable. Both handwarmer muff and fanny pack can also be used separately, and the muff when opened flat, also serves as a seat cushion.

Muffs for warming the hands have been seen for many years, and several combinations of muffs with other devices have been used. The early devices disclosed in the above identified U.S. Pat. Nos. 255,420, and 369,817, are a muff combined with a lunch recepticle, and a muff-pocketbook combination, respectively. Both have the following disadvantages in common: they can be utilized only in one position on the wearer's body, the recepticles in both are a permanent part of the muff not able to be utilized independently of it, are rigid and nonconforming to the body of the wearer and to the contents of the device, are severely limited in their carrying capacity, and are not intended to allow a heat source to be used in conjunction with the muff. A more recent muff, U.S. Pat. No. 2,835,896, identified above, is simply a muff having straps by which it is secured to the front of the wearer's body, and laces by which the size of openings for the hands may be adjusted. There is no provision for carrying a heat source or anything else. U.S. Pat. No. 2,727,241, identified above, is a muff with a pocket for a heat source or handwarmer. It can be used only suspended from the wearer's neck, and has no provision for carrying anything other than a handwarmer. U.S. Pat. No. 3,793,634, differs from the previous muff only in that it offers the hands direct access to the heat source, and that it may be carried over one shoulder. It is designed to carry a small hand-warmer, and nothing else. U.S. Pat. No. 4,408,355, is also a muff with a recepticle for a handwarmer and a device for adjusting the openings for the hands, differing from the foregoing only in that it is worn around the waist on the front of the wearer's body.

The present invention eliminates the disadvantages of the previous designs by providing a means for carrying a muff with handwarmer, and a significant quantity of additional items while permitting both muff and pack to be used independently or in combination, by allowing the muff to be worn separately around the waist or suspended from the neck or in combination with the fanny pack, and by having the ability to conform to the wearer's body and the contents of the pack, thus providing a greater degree of comfort and security to the wearer.

The invention incorporates an insulated muff and a pack, commonly called a fanny pack, because it is worn around the waist in the rear of the wearer. The handwarmer pack combines the function of a pack for carrying equipment and supplies, and a muff which is accessible by turning the fanny pack to the front of the wearer's body. This muff, contained in a special pocket on the outside front of the pack, is removable, allowing the pocket which has snaps for closing the ends to be used to hold other items, and the muff to be used independently either by threading a waist belt through loops on the muff or tying them to a cord around the wearer's neck. The muff itself has a pocket in which a fuel or chemical type handwarmer can be held inside the muff to augment the wearer's body heat. Additionally, the muff, roughly a cylinder, can be opened flat for use as a seat cushion.

The handwarmer pack is a water repellent fabric fanny pack with a flap closure at the top secured by a zipper. A web belt, stitched into the seams at the top of both ends of the pack to which is attached on both loose ends a two piece, adjustable, side release buckle, secures the pack around the waist. A pocket of the same material as the pack, which snaps on both ends for closing it when the muff is not being used, stitched to the front of the pack, contains a muff constructed as follows: A piece of foam insulation is covered on the outside with the same fabric as the pack, and on the inside with a soft flannel cloth to which a pocket of the same flannel has been stitched on three sides, 2½ inches from one edge, and 3½ inches from the edges perpendicular to it. Three snaps, the male component ¼ inch from the edge below the pocket, six inches apart; the female component ¼ inch from the opposite edge, six inches apart, are attached. One loop of the same material as the cover is stitched to each of the other two edges at the midpoint.

BRIEF DESCRIPTIONS OF THE DRAWINGS

FIG. 5 Is a front view of the inside of the muff, opened flat for use as a seat cushion.

FIG. 6 Is a front view of the outside of the muff opened flat for use as a seat cushion.

FIG. 7 Is a front view of the muff snapped shut for use as a handwarmer muff.

FIG. 8 Is a sectional view of the handwarmer muff taken along the line 8—8 of FIG. 7.

DESCRIPTION OF THE PREFERRED EMBODIMENT

Figure 1:
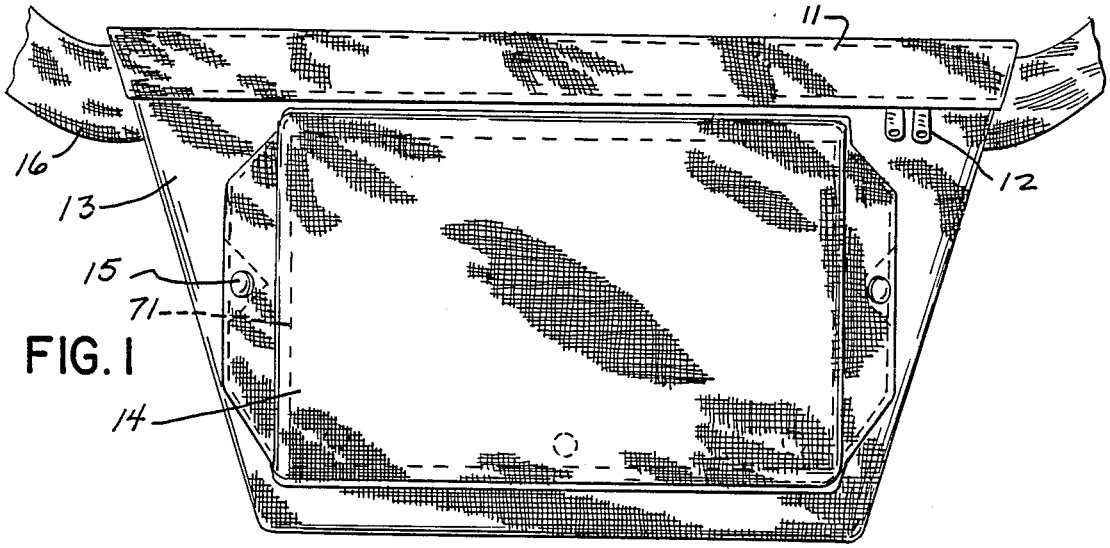
FIG. 1 Is front view of the handwarmer pack showing the pocket which contains the insulated muff.

Referring to FIG. 1, a handwarmer pack 11 comprising a fanny pack 13, the body of which consists of a single piece of water repellent fabric stitched on two side to form a bag, rectangular front and back with the ends roughly triangular, having a wide opening at the top and tapering toward the bottom, said opening at the top having a cover consisting of a flap of the same material stitched to the top of the back panel and closed around the remaining three sides with a zipper 12. A rectangular pocket 14 having snaps 15 at both ends and containing an insulated muff 71, is stitched to the front of said fanny pack 13. A length of web belt 16 is stitched into the two side seams of said fanny pack 13 at the top, and each of the loose ends of said belt 16 attached to the male and female components respectively, of a side release buckle 17, making the back panel of said fanny pack 13 and the lengths of web belt 16 into one continuous waist belt by which said fanny pack 13 is attached to the body of the wearer.

Figure 2:
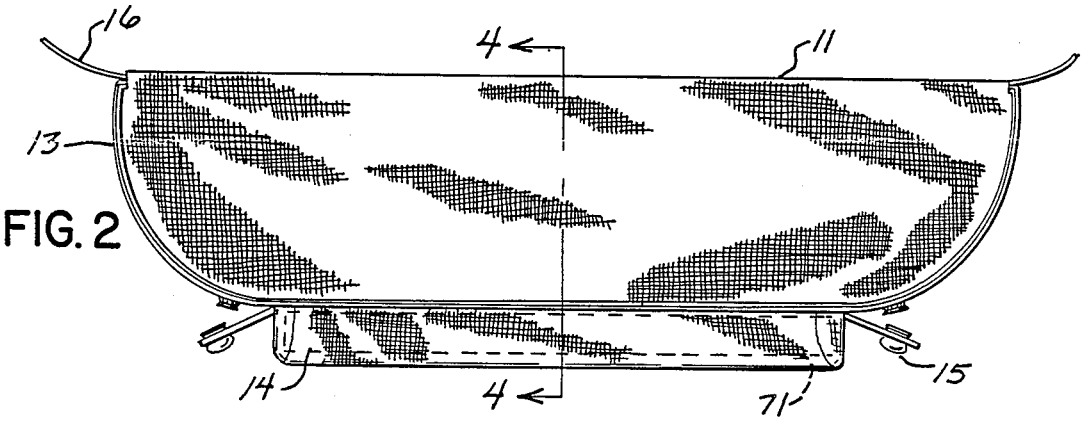
FIG. 2 Is a top view of the handwarmer pack showing the pocket which contains the muff.
Figure 3:
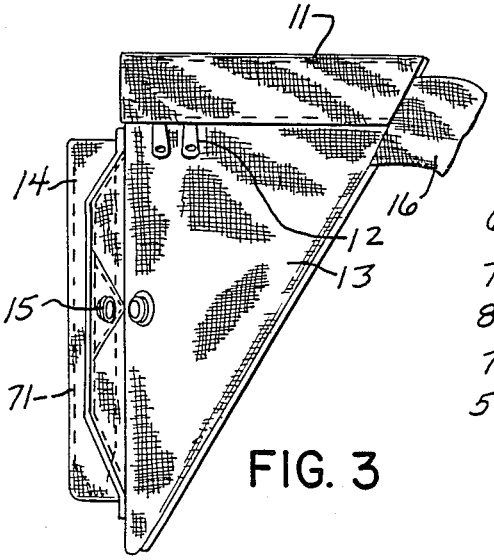
FIG. 3 Is a side view of the handwarmer pack showing the pocket which contains the muff.
Figure 4:
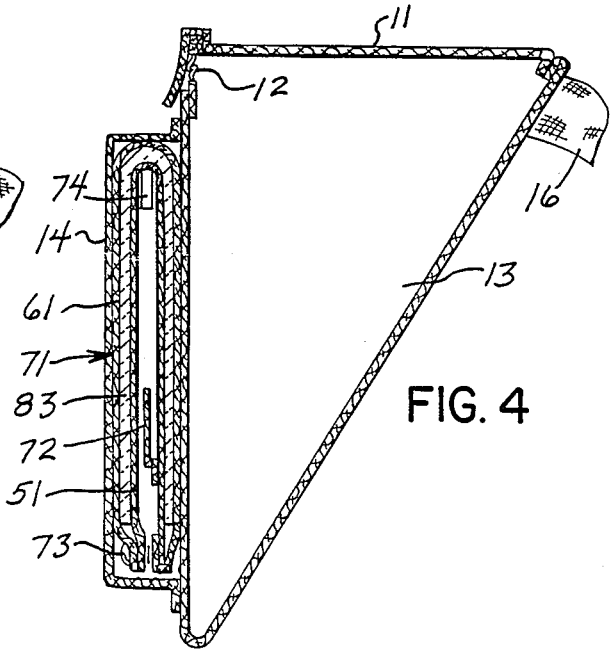
FIG. 4 Is a sectional view of the handwarmer pack, muff pocket, and muff, including the pocket for a fuel or chemical heater, taken along the line 4—4 of FIG. 2.
Figure 9:
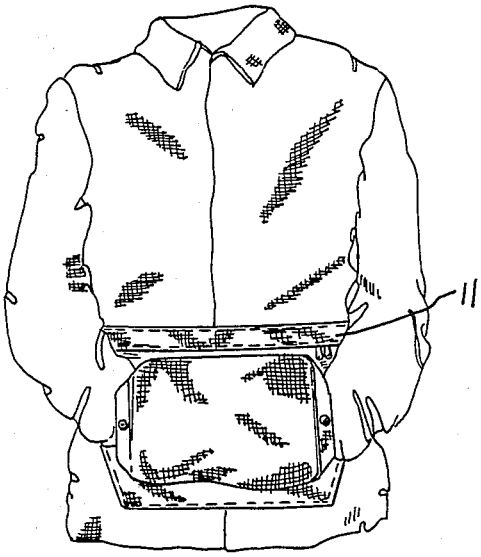
FIG. 9 Is a front view of the handwarmer pack with handwarmer muff in use.
Figure 10:
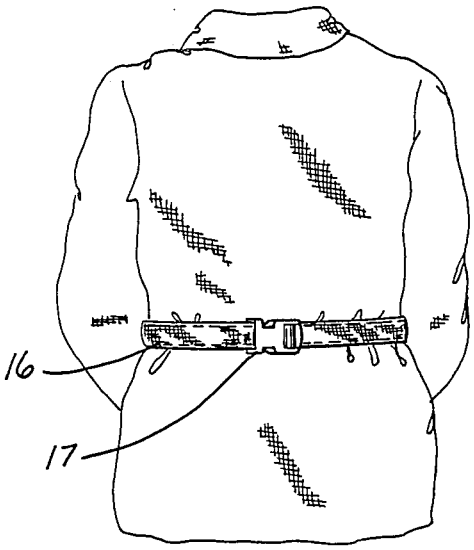
FIG. 10 Is a rear view of the handwarmer pack in use showing the position of the belt and buckle.
Figure 11:
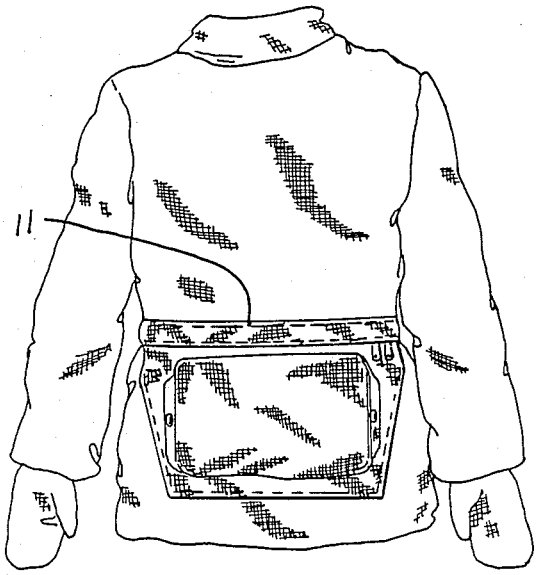
FIG. 11 Is a rear view of user with handwarmer pack in use as a fanny pack.
Figure 12:
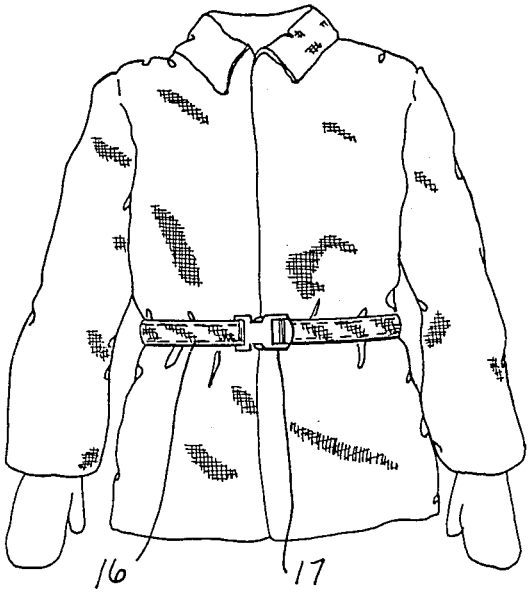
FIG. 12 is a front view of the user with handwarmer pack in use as a fanny pack, showing the position of the belt and buckle.
Figure 13:
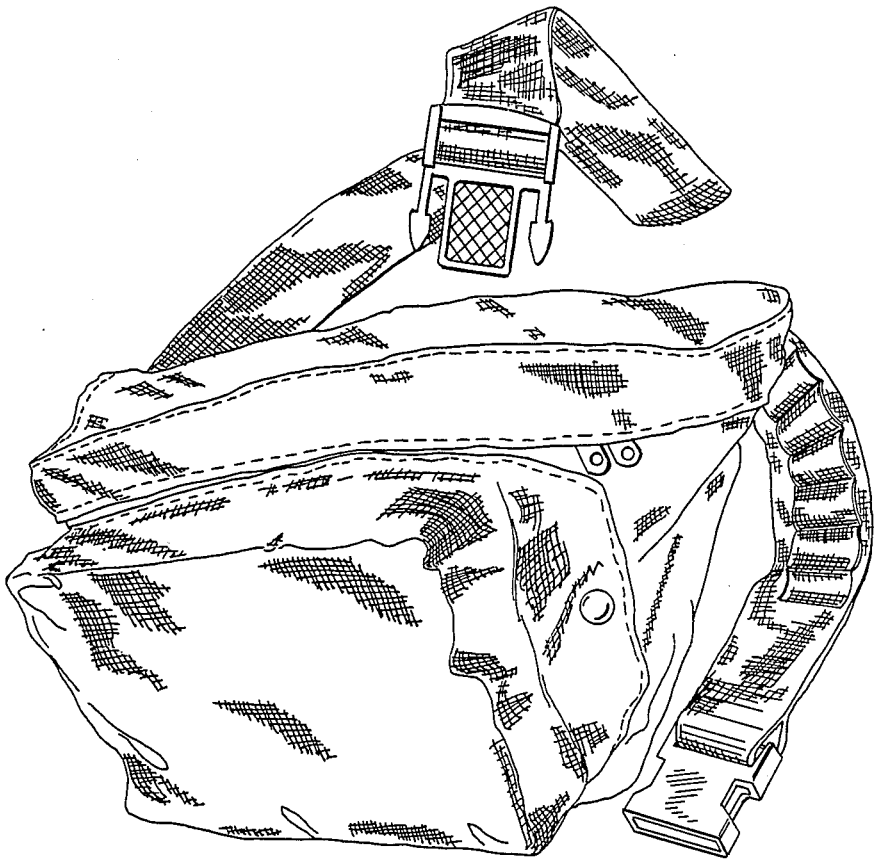
FIG. 13 Is a drawing of the handwarmer pack in perspective showing the buckle in detail.

Referring to FIG. 2, the top view of handwarmer pack 11 described above showing the wide opening at the top of fanny pack 13 covered by said flap closed by zipper 12, the depth of muff pocket 14, and the back panel attached to web belt 16 comprising said waist belt which when drawn around the body of the wearer adjusts the size of said fanny pack 13 to the contents therein and allows said fanny pack 13 to conform to wearer's body. FIG. 3 shows a side view of a handwarmer pack 11 illustrating the wider opening at the top and tapering toward the bottom, the position of muff pocket 14 and muff 71 relative to wearer's body, and the position of web belt 16 around wearer's body. FIG. 4, a sectional view of the same handwarmer pack 11 including the muff 71 comprising a water repellent outer cover 61, a layer of foam insulation 83, a soft flannel inner lining 51, to which is stitched a pocket 72 of the same material which can contain a fuel or chemical type heater, and two loops 74 constructed of the same fabric as the muff cover 61 stitched to the side edges at the midpoint to accomodate a waist belt or a cord around the neck of the wearer. Three snaps 73, 6 inches apart along the bottom edges of muff 71 fasten said edges together forming an oval cylinder. FIG. 5 illustrates how muff 71 can be removed from pocket 14 and opened flat with the lining 51 side up for use as a seat cushion. FIG. 6 shows said rectangular muff 71 opened flat with the water repellent cover 61 side up. FIG. 7 is a front view of muff 71 with its selvage edges fastened together with snaps 73, forming the cylinder which can be inserted into pocket 14 of handwarmer pack 11. FIG. 8 is a sectional view of muff 71 comprising water repellent outer cover 61, foam insulation layer 83, flannel inner lining 51, flannel pocket 72 to contain heater, snaps 73 for closing bottom edges, and loops 74 securing muff 71 to waist belt or neck cord. FIG. 9 illustrates handwarmer pack 11 in use around waist of wearer at the front of wearer's body with wearer's hands inserted in muff 71 through openings at sides on pocket 14. FIG. 10 is a view of the back of wearer's body with hands inserted in muff 71 which is in front of wearer's body, showing the position of web belt 16 and side release buckle 17 which secures handwarmer pack 11 around wearer's waist. FIG. 11 shows a rear view of handwarmer pack 11 at the back of wearer's body used as fanny pack 13. Muff 71 may or may not be present in pocket 14. If muff 71 is not present, pocket 14 may be used to carry other items, and closed at the sides with snaps 15 to prevent loss of said items. FIG. 12, a front view of wearer with handwarmer pack 11 being worn in the rear of wearer's body shows position of belt 16 and buckle 17 in front of wearer. In both FIGS. 11 and 12 handwarmer pack 11 is in position for use as a fanny pack, while in FIGS. 9 and 10 handwarmer pack 11 has been shifted to the front of the wearer's body allowing the muff 71 to be used while inside pocket 14. FIG. 13 depicts handwarmer pack 11 in perspective and the adjustable side release plastic buckle 17 in detail with the male and female components separated as would be the case when removed from the wearer's waist.

The concepts embodied in the design described herein could be expressed in a variety of forms. This application is intended to cover any modifications, variations, or adaptations—particularly but not limited to the method of closing the bottom of the muff and the sides of the pocket into which it fits, and the specific method by which the muff is attached to the fanny pack—that related to the following claims.

I claim:

1. A handwarmer pack comprising

A fanny pack suitable for receiving objects

A strap attached to said funny pack whereby said strap provides a means for affixing the same to a wearer's body A pocket mounted on said fanny pack A muff of a rectangular configuration folded in half and maintained in a cylindrical configuration by use of a releasable fastening means placed at a selvage end of the same and said muff contained in said pocket;

said pocket being open at its lateral ends for permitting insertion of the hands of a wearer into a muff and said muff being removable from said pocket.

2. The said pocket of claim 1 having means for closing the same to permit additional objects to be carried in said pocket when said muff is removed, whereby the closing means includes a second fastener on each of said lateral ends of said pocket.

3. The muff of claim 2 is so formed that it can be opened flat, after removal from said pocket, by opening the said releaseable fastening means, such that the muff assumes its original rectangular configuration (E) The following changes were made in the originally filed claims.

4. The handwarmer pack of claim 1 wherein said muff has loops for attachment to waist belt or neck cord.

5. The handwarmer pack of claim 1 wherein said muff is constructed of a water repellent cover, an insulating layer of foam which maintains its shape but is flexible enough to lay flat, and has a soft lining which is comfortable in contact with the hands.

6. The said muff of claim 5 is so formed that said foam insulation is firm enough to provide cushioning when opened and used as a seat.

7. The said muff of claim 5 is so formed as to maintain its shape and ability to insulate the hands from cold even when removed from the pocket in handwarmer pack.

8. The said muff of claim 7 contains a special flannel pocket capable of containing any type of a fuel or a chemical heater.

* * * * *